US008723899B2

(12) United States Patent
Kim et al.

(10) Patent No.: US 8,723,899 B2
(45) Date of Patent: May 13, 2014

(54) LIQUID CRYSTAL DISPLAY AND METHOD OF DRIVING THE SAME

(75) Inventors: Jongwoo Kim, Kyungbuk (KR); Hyuntaek Nam, Daegu (KR); Suhyuk Jang, Daegu (KR); Myungkook Moon, Daegu (KR)

(73) Assignee: LG Display Co., Ltd., Seoul (KR)

( * ) Notice: Subject to any disclaimer, the term of this patent is extended or adjusted under 35 U.S.C. 154(b) by 494 days.

(21) Appl. No.: 13/117,987

(22) Filed: May 27, 2011

(65) Prior Publication Data

US 2011/0292099 A1 Dec. 1, 2011

(30) Foreign Application Priority Data

May 28, 2010 (KR) ..... 10-2010-0050174

(51) Int. Cl.
*G09G 5/10* (2006.01)

(52) U.S. Cl.
USPC ..... 345/691

(58) Field of Classification Search
None
See application file for complete search history.

(56) References Cited

U.S. PATENT DOCUMENTS

2001/0004253 A1* 6/2001 Fukutoku et al. ..... 345/96
2002/0053999 A1* 5/2002 Chou ..... 345/58
2004/0070581 A1* 4/2004 Hiraki et al. ..... 345/209
2008/0001890 A1* 1/2008 Song et al. ..... 345/96
2009/0195529 A1* 8/2009 Nam et al. ..... 345/213
2009/0251451 A1* 10/2009 Cha et al. ..... 345/211
2011/0037760 A1* 2/2011 Kim et al. ..... 345/214

FOREIGN PATENT DOCUMENTS

CN 101556779 A 10/2009

OTHER PUBLICATIONS

Office Action issued in corresponding Chinese Patent Application No. 201110126259.7, mailed May 30, 2013, 12 pages.

* cited by examiner

*Primary Examiner* — Kent Chang
*Assistant Examiner* — Benjamin Morales Fernandez
(74) *Attorney, Agent, or Firm* — Brinks Gilson & Lione

(57) ABSTRACT

A liquid crystal display and a method of driving the same are disclosed. The liquid crystal display includes a liquid crystal display panel on which data lines and gate lines cross each other, a data driving circuit that converts data of an input image into positive and negative analog data voltages and outputs the data voltages to the data lines, a gate driving circuit sequentially supplying a gate pulse synchronized with the data voltages to the gate lines, and a timing controller that supplies the input image data to the data driving circuit, controls an operation timing of each of the data driving circuit and the gate driving circuit, compares the input image data with a previously stored reference data pattern, and decides whether or not the input image data is the same as the reference data pattern.

10 Claims, 14 Drawing Sheets

| | V2, H1 | V2, H1 |
|---|---|---|
| Shutdown | |   |
| Smear | |   |
| flicker |   | |

LIQUID CRYSTAL DISPLAY AND METHOD OF DRIVING THE SAME

This application claims the benefit of Korean Patent Application No. 10-2010-0050174 filed on May 28, 2010, which is incorporated herein by reference for all purposes as if fully set forth herein.

BACKGROUND

1. Field of the Disclosure

Embodiments of the invention relate to a liquid crystal display and a method of driving the same.

2. Discussion of the Related Art

Active matrix type liquid crystal displays display a motion picture using a thin film transistor (TFT) as a switching element. The active matrix type liquid crystal displays have been implemented in televisions as well as display devices in portable devices such as office equipments and computers, because of the thin profile of the active matrix type liquid crystal displays.

Liquid crystal cells of the liquid crystal display change a transmittance by a potential difference between a data voltage supplied to a pixel electrode and a common voltage supplied to a common electrode, thereby displaying an image. The liquid crystal display is generally driven in an inversion scheme of periodically inverting a polarity of the data voltage applied to liquid crystal cell so as to prevent deterioration of the liquid crystal. When the liquid crystal display is driven in the inversion scheme, the image quality of the liquid crystal display may be reduced depending on a correlation between the polarities of the data voltages charged to the liquid crystal cells and a data pattern of an input image. This is because the polarities of the data voltages charged to the liquid crystal cells are not balanced between the positive and negative polarities and one of the positive and negative polarities becomes dominant. Hence, the common voltage applied to the common electrode shifts. When the common voltage shifts, a reference potential of the liquid crystal cells swings. Therefore, this may cause an observer to sense a crosstalk, a flicker, or a smear in an image displayed on the liquid crystal display.

FIG. 1 shows data examples of problem patterns which may result in a reduction of the image quality of a liquid crystal display when the liquid crystal display is driven in a dot inversion scheme.

As shown in FIG. 1, among the problem patterns, a pattern in which (white) pixel data of a white gray level and (black) pixel data of a black gray level alternate every one pixel is referred to as a shutdown pattern. Each pixel data includes red subpixel data R, green subpixel data G, and blue subpixel data B. The shutdown pattern may be detected by counting shutdown patterns included in an input image and determining whether or not the data of the input image is the shutdown pattern based on the count value. For example, when Nth (N is a positive integer) pixel data is pixel data of the white gray level and (N+1)th pixel data is pixel data of the black gray level, a count value of a problem pixel counter increases by 1. When the count value is equal to or greater than a predetermined threshold value, the data of the input image is decided as the shutdown pattern.

As shown in FIG. 2, it is necessary to previously define a maximum number of patterns (i.e., $(2^3-1)\cdot 2=14$) that may appear in six subpixels, so as to recognize the shutdown pattern. Further, a detection logic module for detecting each of the 14 patterns is required.

The problem patterns include various patterns resulting in the reduction of the image quality in the dot inversion scheme as well as the shutdown pattern. Examples of the problem patterns include a smear pattern and a flicker pattern as shown in FIG. 12.

If the flick er pattern is recognized from the input image, a method capable of preventing the flicker by changing the inversion period of the polarity in the dot inversion scheme may be considered. One example of the method is disclosed in disclosed in detail in U.S. patent application Ser. No. 12/830,971, Publication No. US 2011/0037760 A1 corresponding to Korean Patent Application No. 10-2009-0075382 filed Aug. 14, 2009, which are hereby incorporated by reference in their entirety. However, in the method, when the dot inversion scheme is changed through the recognition of the flicker pattern, the flicker does not appear. Therefore, it is difficult to decide the shift of the common voltage. Accordingly, when the flicker pattern is input, it is difficult to determine a shift degree of the common voltage in a common voltage tuning process if the dot inversion scheme is changed. Therefore, it is difficult to optimize the common voltage.

SUMMARY

Embodiments of the invention provide a liquid crystal display and a method of driving the same capable of automatically changing in a dot inversion scheme providing the good image quality when problem patterns are input and capable of tuning a common voltage.

In one aspect, there is a liquid crystal display comprising a liquid crystal display panel on which data lines and gate lines cross each other, a data driving circuit configured to convert data of an input image into positive and negative analog data voltages and output the positive and negative analog data voltages to the data lines, a gate driving circuit configured to sequentially supply a gate pulse synchronized with the data voltages to the gate lines, and a timing controller configured to supply the input image data to the data driving circuit, control an operation timing of each of the data driving circuit and the gate driving circuit, compare the input image data with a previously stored reference data pattern, and decide whether or not the input image data is the same as the reference data pattern. When the input image data is the same as the reference data pattern, the timing controller recognizes the input image data as a first problem pattern, disables an operation for counting data of a white gray level, and controls horizontal polarities of the data voltages output from the data driving circuit in a horizontal 1 dot inversion scheme. When the input image data is not the same as the reference data pattern, the timing controller recognizes the input image data as a second problem pattern, enables the operation for counting the data of the white gray level, decides a shift of a common voltage based on a count value, and controls the horizontal polarities of the data voltages output from the data driving circuit in a horizontal 2 dot inversion scheme so as to minimize the shift of the common voltage.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail embodiments of the invention examples of which are illustrated in the accompanying drawings.

Figure 1:
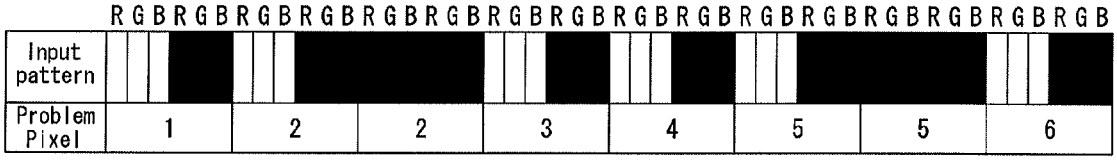
FIG. 1 (RELATED ART)
FIGS. 1 and 2 illustrate exemplary problem patterns capable of resulting in a shift of a common voltage.
Figure 2:
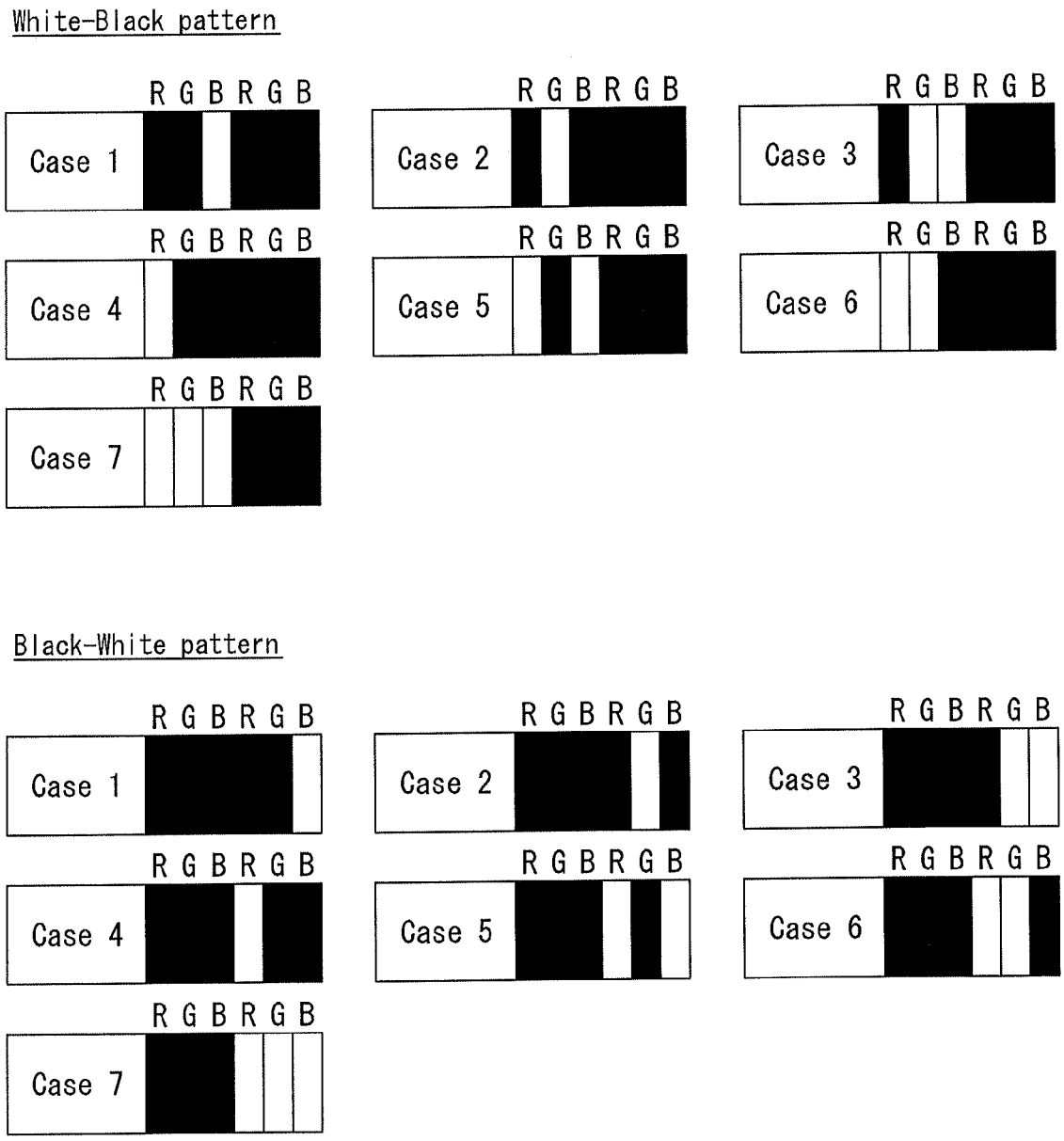
FIG. 2 (RELATED ART)
Figure 3:
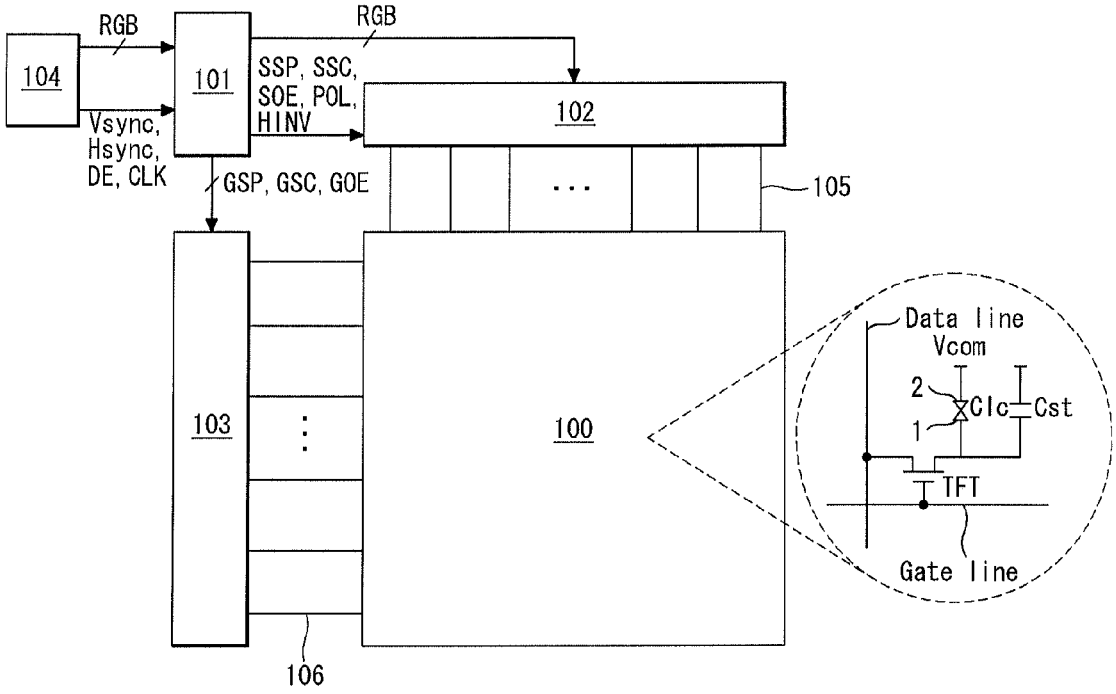
FIG. 3 is a block diagram of a liquid crystal display according to an exemplary embodiment of the invention.

As shown in FIG. 3, a liquid crystal display according to an exemplary embodiment of the invention includes a liquid crystal display panel 100, a timing controller 101, a data driving circuit 102, and a gate driving circuit 103. The data driving circuit 102 includes a plurality of source driver integrated circuits (ICs). The gate driving circuit 103 includes a plurality of gate driver ICs.

The liquid crystal display panel 100 includes an upper glass substrate, a lower glass substrate, and a liquid crystal layer between the upper and lower glass substrates. The liquid crystal display panel 100 includes liquid crystal cells Clc arranged at crossings of data lines 105 and gate lines 106 in a matrix form.

Figure 4:
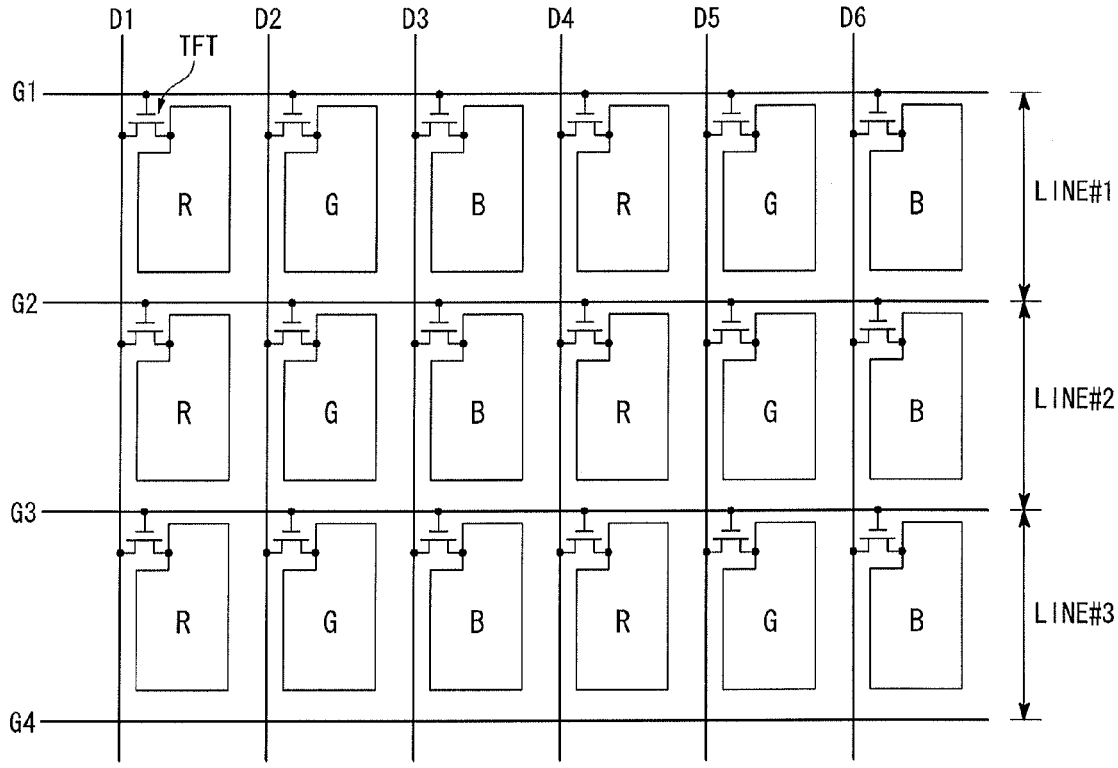
FIGS. 4 to 6 illustrate various examples of a pixel array.
Figure 5:
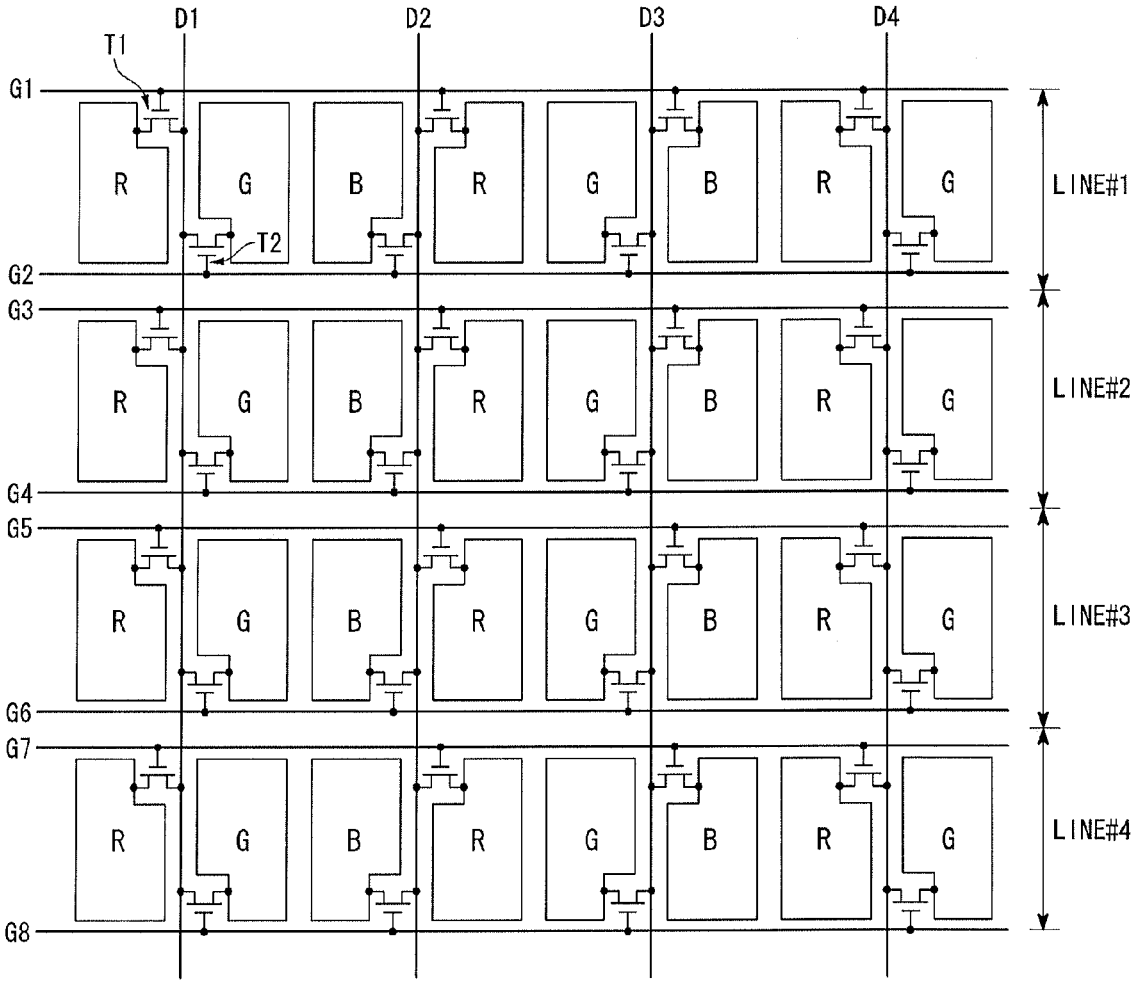
Figure 6:
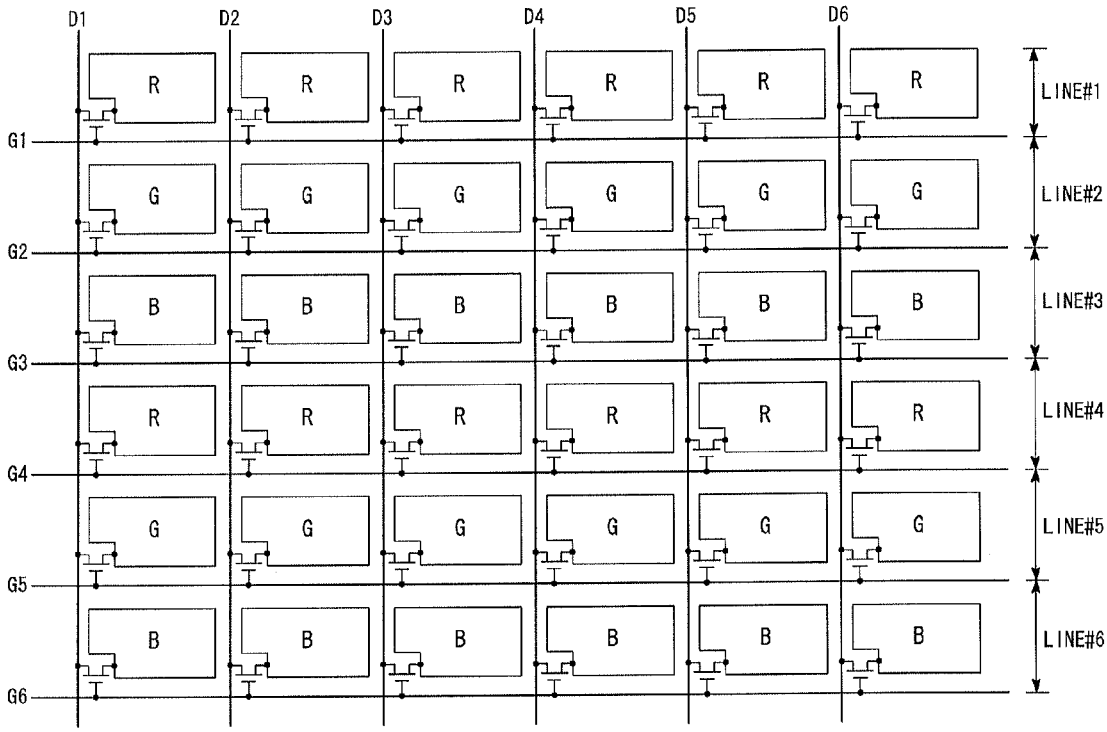

A pixel array is formed on the lower glass substrate of the liquid crystal display panel 100. The pixel array includes the liquid crystal cells Clc formed at crossings of the data lines 105 and the gate lines 106, thin film transistors (TFTs) connected to pixel electrodes 1 of the liquid crystal cells, and storage capacitors Cst. The pixel array may be implemented in various manners as shown in FIGS. 4 to 6. The liquid crystal cells Clc are connected to the TFTs and are driven by an electric field between the pixel electrodes 1 and common electrodes 2. Black matrixes, color filters, etc. are formed on the upper glass substrate of the liquid crystal display panel 100. Polarizing plates are respectively attached to the upper and lower glass substrates of the liquid crystal display panel 100. Alignment layers for setting a pre-tilt angle of the liquid crystal are respectively formed on the upper and lower glass substrates of the liquid crystal display panel 100.

In a vertical electric field driving manner such as a twisted nematic (TN) mode and a vertical alignment (VA) mode, the common electrode 2 is formed on the upper glass substrate. In a horizontal electric field driving manner such as an in-plane switching (IPS) mode and a fringe field switching (FFS) mode, the common electrode 2 is formed on the lower glass substrate along with the pixel electrode 1.

The liquid crystal display panel 100 applicable to the embodiment of the invention may be implemented in any liquid crystal mode as well as the TN, VA, IPS, and FFS modes. The liquid crystal display according to the embodiment of the invention may be implemented as any type liquid crystal display including a backlit liquid crystal display, a transflective liquid crystal display, and a reflective liquid crystal display. A backlight unit is necessary in the backlit liquid crystal display and the transflective liquid crystal display. The backlight unit may be implemented as a direct type backlight unit or an edge type backlight unit.

The timing controller 101 supplies digital video data RGB of an input image received from a system board 104 to the data driving circuit 102. The timing controller 101 receives timing signals, such as a vertical sync signal Vsync, a horizontal sync signal Hsync, a data enable DE, and a dot clock CLK, from the system board 104 and generates control signals for controlling operation timing of each of the data driving circuit 102 and the gate driving circuit 103. The control signals include a gate timing control signal for controlling the operation timing of the gate driving circuit 103 and a data timing control signal for controlling the operation timing of the data driving circuit 102 and a vertical polarity of a data voltage. The timing controller 101 is able to multiply a frequency of the gate timing control signal by a frequency of the data timing control signal based on a frame frequency of (60□i) Hz, where "i" is a positive integer, so that the digital video data input at a frame frequency of 60 Hz can be reproduced on the pixel array of the liquid crystal display panel 100 at the frame frequency of (60□i) Hz.

The gate timing control signal includes a gate start pulse GSP, a gate shift clock GSC, a gate output enable GOE, and the like. The gate start pulse GSP is applied to a gate driver IC to generate a first gate pulse and controls the gate drive IC so that the gate drive IC can generate the first gate pulse. The gate shift clock GSC is commonly input to the gate driver ICs and shifts the gate start pulse GSP. The gate output enable GOE controls an output of the gate driver ICs.

The data timing control signal includes a source start pulse SSP, a source sampling clock SSC, a vertical polarity control signal POL, a horizontal polarity control signal HINV, a source output enable SOE, and the like. The source start pulse SSP controls a data sampling start timing of the data driving circuit 102. The source sampling clock SSC controls a sampling timing of data in each of the source driver ICs based on a rising or falling edge. The vertical polarity control signal POL controls vertical polarities of the data voltages sequentially output from the source driver ICs. The horizontal polarity control signal HINV is supplied to an H_2DOT optional terminal of each of the source driver ICs and controls horizontal polarities of the data voltages simultaneously output from the source driver ICs. A logic level of the vertical polarity control signal POL is inverted every two horizontal periods when controlling the data driving circuit 102 in a vertical 2 dot inversion scheme, and is inverted every one horizontal period when controlling the data driving circuit 102 in a vertical 1 dot inversion scheme. The horizontal polarity control signal HINV is generated at a high logic level when controlling the data driving circuit 102 in a horizontal 2 dot inversion scheme, and is generated at a low logic level when controlling the data driving circuit 102 in a horizontal 1 dot inversion scheme. The source output enable SOE controls an output timing of the data driving circuit 102. If the digital video data to be input to the data driving circuit 102 is transmitted based on a mini low voltage differential signaling (LVDS) interface standard, the source start pulse SSP and the source sampling clock SSC may be omitted.

Figure 11:
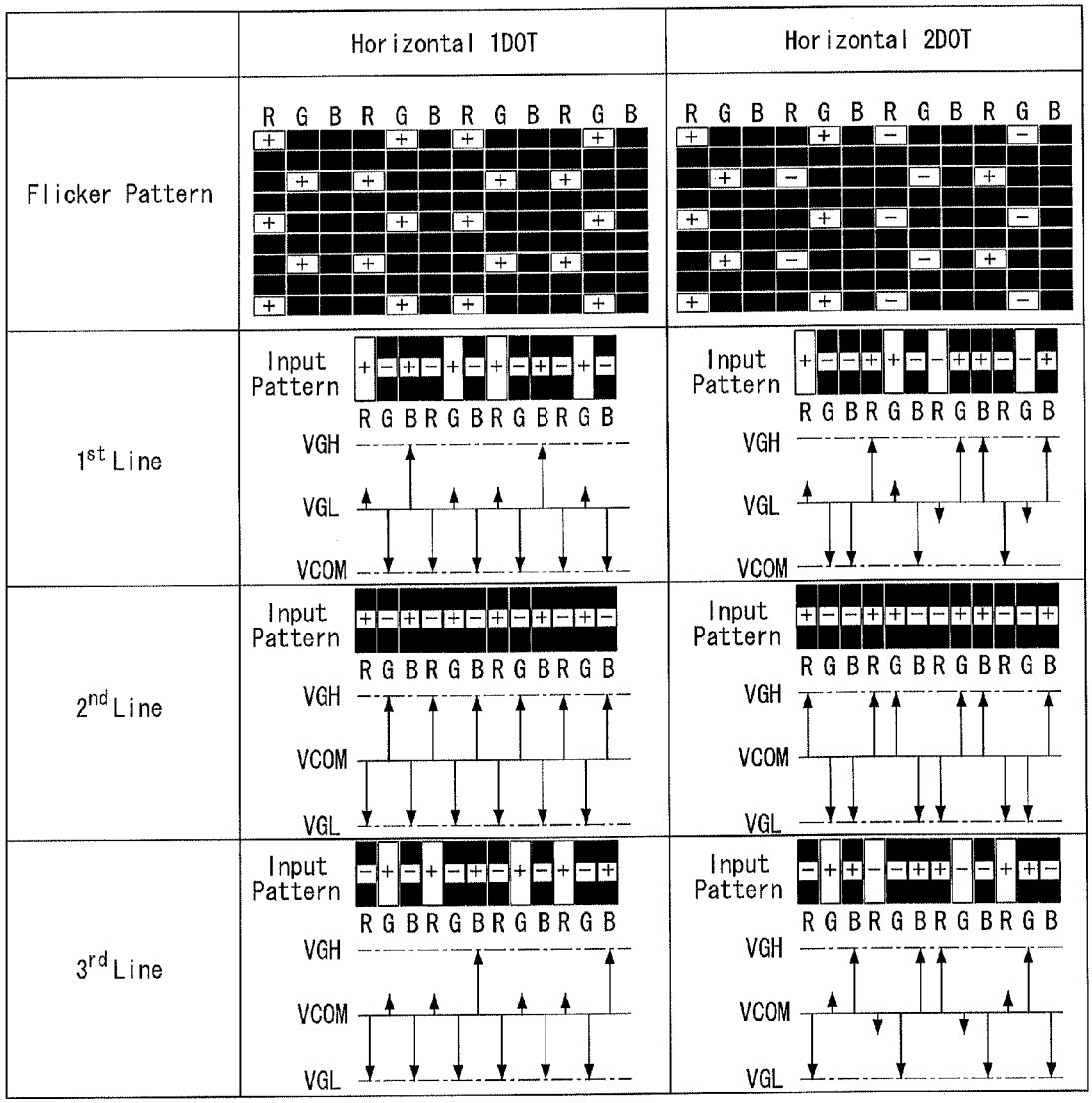
FIG. 11 illustrates a polarity bias of data and a shift of a common voltage in a flicker pattern based on a dot inversion scheme.
Figure 12:
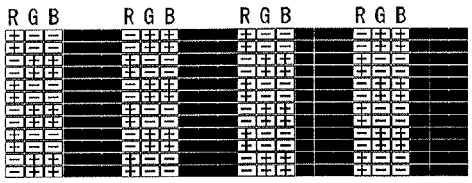
FIG. 12 illustrates an example of changing a dot inversion scheme in various problem patterns.
Figure 12:
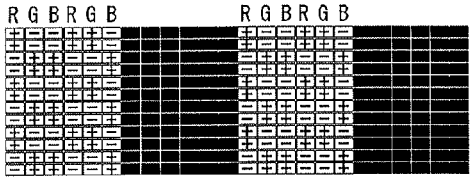
Figure 12:
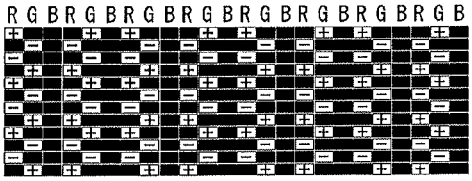

The timing controller 101 recognizes various types of problem patterns in the data of the input image and changes a dot inversion scheme when the various types of problem patterns are detected. For example, when the timing controller 101 recognizes a shutdown pattern or a smear pattern among the problem patterns, the timing controller 101 inverts the logic level of the horizontal polarity control signal HINV to the high logic level, thereby changing a dot inversion scheme of the liquid crystal display panel 100 to a horizontal 2 dot inversion scheme. However, when the timing controller 101 recognizes a flicker pattern as shown in FIGS. 11 and 12, the timing controller 101 does not change the dot inversion scheme. This is to recognize a shift degree of the common voltage in a common voltage tuning process.

Each of the source driver ICs of the data driving circuit 102 includes a shift register, a latch, a digital-to-analog converter, an output buffer, and the like. The data driving circuit 102 latches the digital video data RGB under the control of the timing controller 101. The data drive circuit 102 converts the digital video data RGB into analog positive and negative gamma compensation voltages in response to the vertical polarity control signal POL and inverts the polarity of the data voltage. The data drive circuit 102 simultaneously outputs the data voltages having a polarity pattern of the horizontal dot inversion scheme determined based on the horizontal polarity control signal HINV.

The gate driving circuit 103 sequentially supplies the gate pulse to the gate lines 106 using the shift register and a level shifter in response to the gate timing control signals.

FIGS. 4 to 6 are equivalent circuit diagrams illustrating various examples of the pixel array.

The pixel array of FIG. 4 is a pixel array applied to most of liquid crystal displays, in which data lines D1 to D6 and gate lines G1 to G4 cross each other. In the pixel array of FIG. 4, red subpixels R, green subpixels G, and blue subpixels B are arranged in a column direction. Each of the TFTs supplies the data voltage from the data lines D1 to D6 to the pixel electrode of the liquid crystal cell disposed on the left or right side of each of the data lines D1 to D6 in response to the gate pulse from the gate lines G1 to G4. In the pixel array of FIG. 4, one pixel includes a red subpixel R, a green subpixel G, and a blue subpixel B that are adjacent to one another in a row direction (or line direction) crossing the column direction. When a resolution of the pixel array of FIG. 4 is m·n, where m and n are a positive integer, m·3 data lines and n gate lines are required, where 3 indicates the red, green, and blue subpixels R, G, and B. The gate pulse of one horizontal period synchronized with the data voltage is sequentially supplied to the gate lines of the pixel array of FIG. 4.

The number of data lines in the pixel array of FIG. 5 may be reduced to ½ of that in the pixel array of FIG. 4 at the same resolution. Thus, the number of source driver ICs required in the data lines of the pixel array of FIG. 5 may be reduced to ½ of that in the pixel array of FIG. 4. In the pixel array of FIG. 5, red subpixels R, green subpixels G, and blue subpixels B are arranged in the column direction. In the pixel array of FIG. 5, one pixel includes a red subpixel R, a green subpixel G, and a blue subpixel B that are adjacent to one another in the line direction crossing the column direction. Further, the adjacent liquid crystal cells disposed on the left and right sides of each of data lines D1 to D4 share one data line and are successively charged to the data voltages supplied through the one data line in a time-division manner. In the pixel array of FIG. 5, the liquid crystal cell and the TFT disposed on the left side of each of the data lines D1 to D4 are respectively defined as a first liquid crystal cell and a first TFT T1, and the liquid crystal cell and the TFT disposed on the right side of each of the data lines D1 to D4 are respectively defined as a second liquid crystal cell and a second TFT T2. The first TFTs T1 of the pixel array of FIG. 5 supply the data voltages from the data lines D1 to D4 to the pixel electrodes of the first liquid crystal cells in response to the gate pulse from the odd-numbered gate lines G1, G3, G5, and G7. Gate electrodes of the first TFTs T1 are connected to the odd-numbered gate lines G1, G3, G5, and G7, drain electrodes of the firsts TFTs T1 are connected to the data lines D1 to D4, and source electrodes of the first TFTs T1 are connected to the pixel electrodes of the first liquid crystal cells. The second TFTs T2 supply the data voltages from the data lines D1 to D4 to the pixel electrodes of the second liquid crystal cells in response to the gate pulse from the even-numbered gate lines G2, G4, G6, and G8. Gate electrodes of the second TFTs T2 are connected to the even-numbered gate lines G2, G4, G6, and G8, drain electrodes of the second TFTs T2 are connected to the data lines D1 to D4, and source electrodes of the second TFTs T2 are connected to the pixel electrodes of the second liquid crystal cells. When a resolution of the pixel array of FIG. 5 is m□n, (m□3/2) data lines and 2n gate lines are required, where 3 indicates the red, green, and blue subpixels R, G, and B. The gate pulse of ½ horizontal period synchronized with the data voltages is sequentially supplied to the gate lines of the pixel array.

The number of data lines in the pixel array of FIG. 6 may be reduced to ⅓ of that in the pixel array of FIG. 4 at the same resolution. Thus, the number of source driver ICs required in the data lines of the pixel array of FIG. 6 may be reduced to ⅓ of that in the pixel array of FIG. 4. In the pixel array of FIG. 6, red subpixels R, green subpixels G, and blue subpixels B are arranged in the line direction. In the pixel array of FIG. 6, one pixel includes a red subpixel R, a green subpixel G, and a blue subpixel B that are adjacent to one another in the column direction. Each of the TFTs supplies the data voltage from the data lines D1 to D6 to the pixel electrode of the liquid crystal cell disposed on the left or right side of each of the data lines D1 to D6 in response to the gate pulse from the gate lines G1 to G6. When a resolution of the pixel array of FIG. 6 is m·n, m data lines and 3n gate lines are required. The gate pulse of ⅓ horizontal period synchronized with the data voltages is sequentially supplied to the gate lines of the pixel array.

Figure 7:
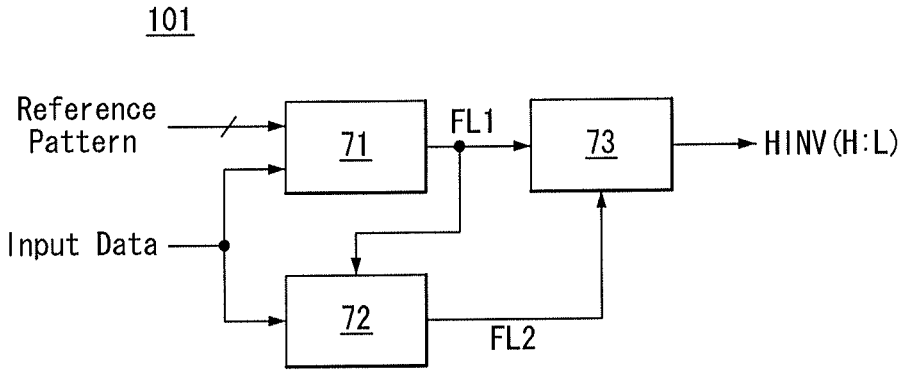
FIG. 7 is a block diagram illustrating a problem pattern recognition unit and a polarity control unit of a timing controller.
Figure 8:
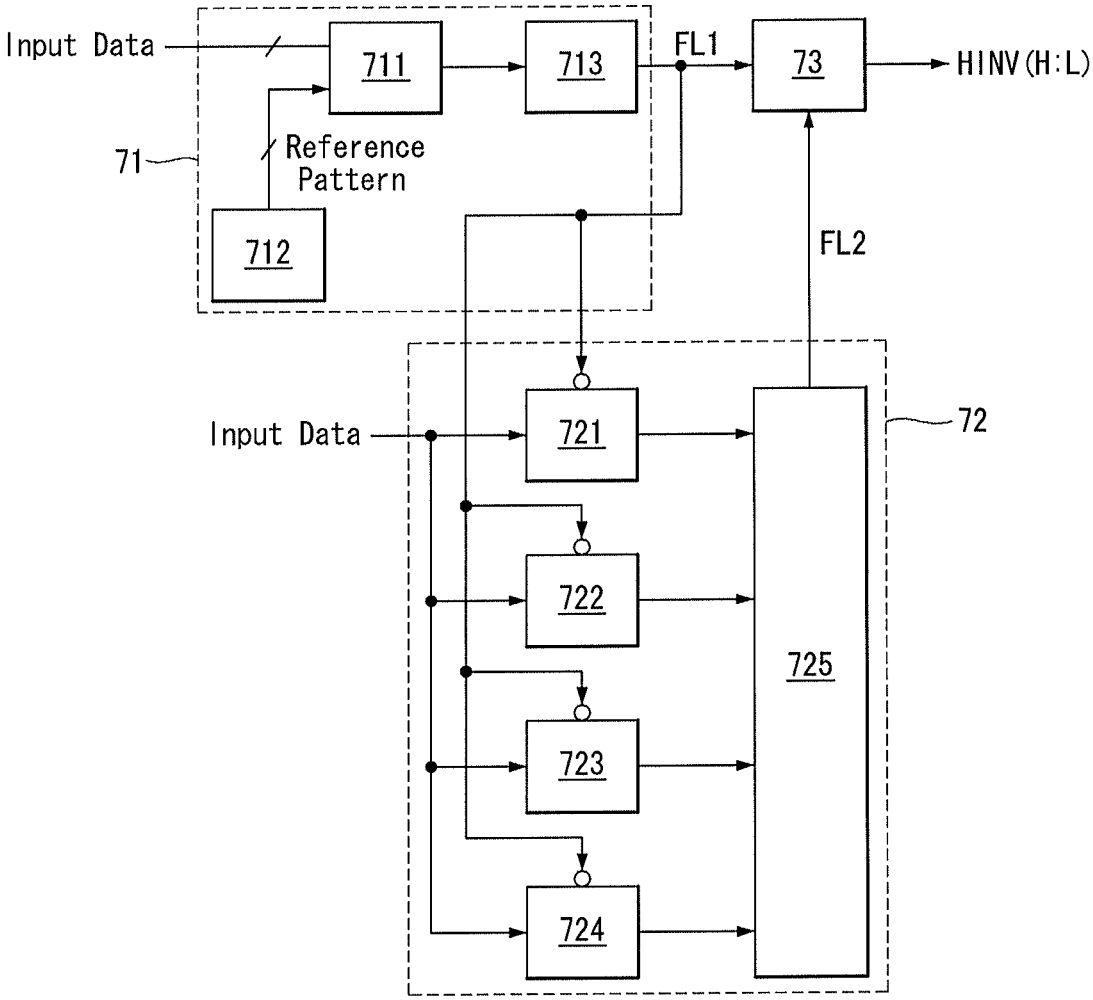
FIG. 8 illustrates first and second problem pattern recognition units.
Figure 9:
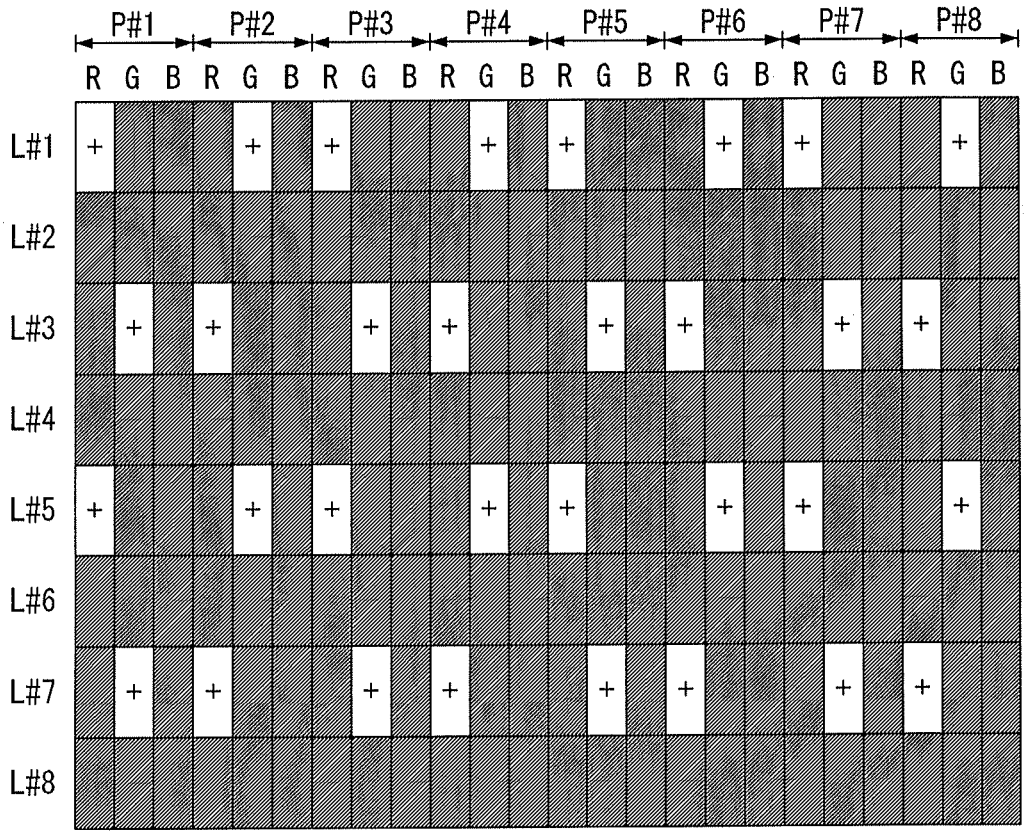
FIG. 9 illustrates an input data sample of (8 pixels)×(8 lines)
Figure 10:
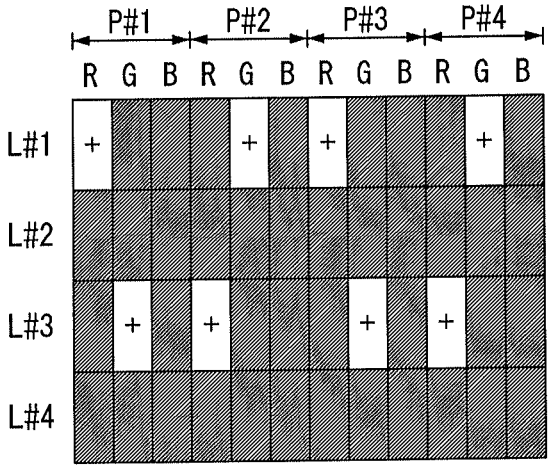
FIG. 10 illustrates a reference data pattern of (4 pixels)×(4 lines) used to detect a flicker pattern.

FIGS. 7 and 8 are block diagrams illustrating problem pattern recognition units and a polarity control unit of the timing controller 101. FIG. 9 illustrates a sampled data among data of one frame. FIG. 10 illustrates a reference data pattern used to detect a flicker pattern.

As shown in FIG. 7, the timing controller 101 includes a first problem pattern recognition unit 71 for detecting a flicker pattern among various problem patterns from data of the input image, a second problem pattern recognition unit 72 for detecting problem patterns other than the flicker pattern, and a polarity control unit 73.

As shown in FIG. 8, the first problem pattern recognition unit 71 includes a comparator 711, a memory 712, and a flicker pattern deciding unit 713, thereby detecting whether or not the input image data is the flicker pattern. The memory 712 is used to detect the flicker pattern and previously stores a reference data pattern of a predetermined size, for example, (4 pixels P#1-P#4)×(4 lines L#1-L#4) as shown in FIG. 10. The memory 712 may be replaced by an inner register of the timing controller 101. The comparator 711 extracts a sample data of a predetermined size, for example, (8 pixels P#1-P#8)×(8 lines L#1-L#8) as shown in FIG. 9, among data of one frame of the input image. The comparator 711 compares the sample data with the reference data pattern stored in the memory 712 in each subpixel. The flicker pattern deciding unit 713 decides whether or not the sample data is the same as the reference data pattern based on the result of a comparison received from the comparator 711. When the sample data is the same as the reference data pattern, the flicker pattern deciding unit 713 recognizes the input image data as the flicker pattern generating the common voltage shift and generates a first problem pattern flag FL1 of a first logic level (for example, a high logic level), thereby disabling an operation of the second problem pattern recognition unit 72. On the other hand, when the sample data is not the same as the reference data pattern, the flicker pattern deciding unit 713 decides that the input image data is not the flicker pattern, and generates the first problem pattern flag FL1 of a second logic level (for example, a low logic level), thereby enabling an operation of the second problem pattern recognition unit 72.

The second problem pattern recognition unit 72 includes first to fourth counter 721-724 and a common voltage shift deciding unit 725, thereby detecting problem patterns (for example, a shutdown pattern and a smear pattern) other than the flicker pattern.

Counting operations of the first to fourth counters 721-724 are enabled only when the first problem pattern flag FL1 of the low logic level is received from the flicker pattern deciding unit 713. The first counter 721 respectively maps the input image data to polarity patterns of a horizontal 1 dot inversion scheme and counts the number of data with white gray level mapped to the positive polarity. The second counter 722 respectively maps the input image data to the polarity patterns of the horizontal 1 dot inversion scheme and counts the number of data with white gray level mapped to the negative polarity. The third counter 723 respectively maps the input image data to polarity patterns of a horizontal 2 dot inversion scheme and counts the number of data with white gray level mapped to the positive polarity. The fourth counter 724 respectively maps the input image data to the polarity patterns of the horizontal 2 dot inversion scheme and counts the number of data with white gray level mapped to the negative polarity.

The common voltage shift deciding unit 725 receives a count accumulated value of the data of one line from the first and second counter 721 and 722 and calculates a difference between the number of data with white gray level mapped to the positive polarity and the number of data with white gray level mapped to the negative polarity. The common voltage shift deciding unit 725 then compares the result of a calculation with a predetermined reference value. When the common voltage shift deciding unit 725 inverts the polarity of the data voltage of the input image in the horizontal 1 dot inversion scheme, the common voltage shift deciding unit 725 obtains a first common voltage shift amount indicating a shift amount of the common voltage based on the result of a comparison. Further, the common voltage shift deciding unit 725 receives a count accumulated value of the data of one line from the third and fourth counter 723 and 724 and calculates a difference between the number of data with white gray level mapped to the positive polarity and the number of data with white gray level mapped to the negative polarity. The common voltage shift deciding unit 725 then compares the result of a calculation with a predetermined reference value. When the common voltage shift deciding unit 725 inverts the polarity of the data voltage of the input image in the horizontal 2 dot inversion scheme, the common voltage shift deciding unit 725 obtains a second common voltage shift amount indicating a shift amount of the common voltage based on the result of a comparison. The common voltage shift deciding unit 725 compares the first common voltage shift amount with the second common voltage shift amount. When the first common voltage shift amount is greater than the second common voltage shift amount, the common voltage shift deciding unit 725 recognizes the input image data as problem patterns other than the flicker pattern and generates a second problem pattern flag FL2 of the high logic level. On the contrary, when the first common voltage shift amount is less than the second common voltage shift amount, the common voltage shift deciding unit 725 recognizes the input image data as a normal data and generates the second problem pattern flag FL2 of the low logic level.

The polarity control unit 73 determines the logic level of the horizontal polarity control signal HINV based on the logic level of the first problem pattern flag FL1 received from the first problem pattern recognition unit 71 and the logic level of the second problem pattern flag FL2 received from the second problem pattern recognition unit 72. When the first problem pattern flag FL1 of the high logic level is input (i.e., when the input image data is the flicker pattern), the polarity control unit 73 generates the horizontal polarity control signal HINV of the low logic level. The polarity control unit 73 then controls the polarities of the data voltages in the horizontal 1 dot inversion scheme specified to a default value in the source driver ICs without changing the dot inversion scheme. When the first problem pattern flag FL1 of the low logic level and the second problem pattern flag FL2 of the high logic level are input (i.e., when the input image data is any problem pattern other than the flicker pattern), the polarity control unit 73 generates the horizontal polarity control signal HINV of the high logic level and controls the polarities of the data voltages in the horizontal 2 dot inversion scheme through a change in the dot inversion scheme. When the first problem pattern flag FL1 of the low logic level and the second problem pattern flag FL2 of the low logic level are input (i.e., when the input image data is the normal data), the polarity control unit 73 generates the horizontal polarity control signal HINV of the low logic level and controls the polarities of the data voltages in the horizontal 1 dot inversion scheme without changing the dot inversion scheme. The polarity control unit 73 may vary a logic inversion period of the vertical polarity control signal POL along with the horizontal polarity control signal HINV based on the logic levels of the first and second problem pattern flags FL1 and FL2.

FIG. 11 illustrates a polarity bias of data and the common voltage shift in the flicker pattern based on the dot inversion scheme. FIG. 12 illustrates an example of changing a dot inversion scheme in various problem patterns.

As shown in FIGS. 11 and 12, the shutdown pattern is data in which pixel data of white gray level and pixel data of black gray level alternate every one pixel. The smear pattern is data in which pixel data of white gray level and pixel data of black gray level alternate every two pixels. In the flicker pattern, R data of Nth pixel data and G data of (N+1)th pixel data on (4i+1)th lines LINE#1, LINE#5, and LINE#9 are data with white gray level, where "i" is a natural number including zero, G data of the Nth pixel data and R data of the (N+1)th pixel data on (4i+3)th lines LINE#3, LINE#7, and LINE#11 are data with white gray level, and other data is data with black gray level.

As described above, the liquid crystal display according to the embodiment of the invention previously defines various types of problem patterns such as the shutdown pattern, the smear pattern, and the flicker pattern. When the problem patterns other than the flicker pattern are input, the liquid crystal display is driven in the horizontal 2 dot inversion scheme as shown in FIG. 12 to thereby minimize the shift of the common voltage. Further, when the flicker pattern is input, the liquid crystal display is driven in the horizontal 1 dot inversion scheme and holds the shifted state of the common voltage as shown in FIG. 11, thereby optimizing the common voltage in the common voltage tuning process.

Figure 13:
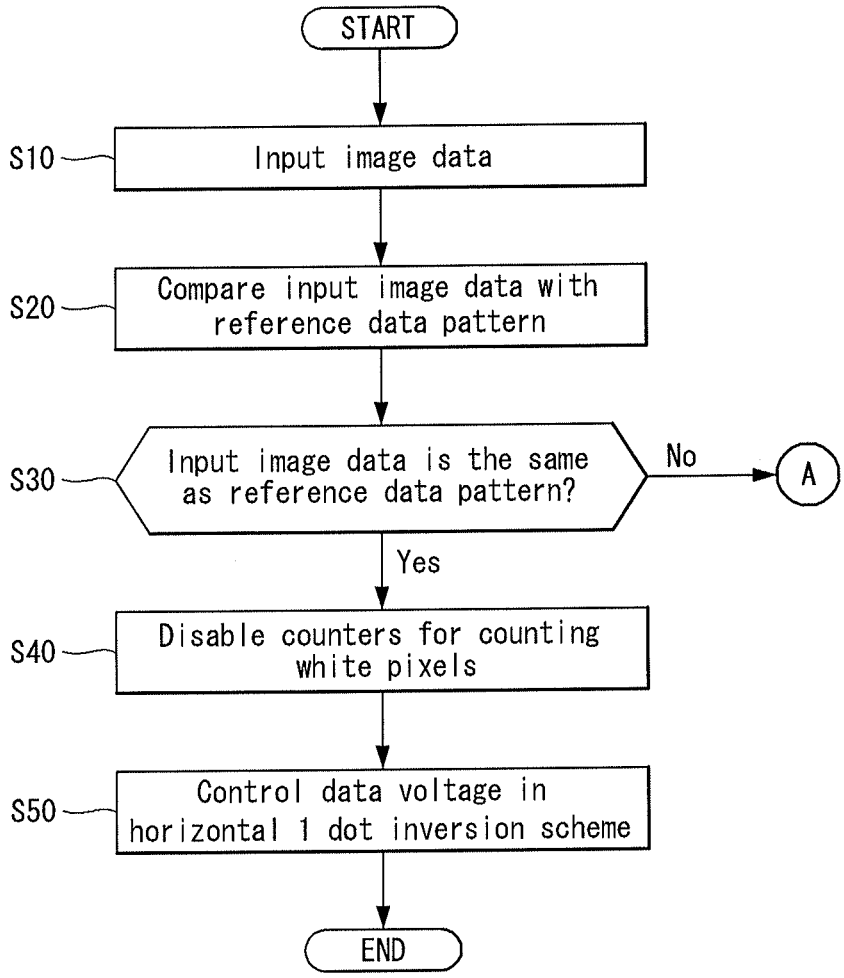
FIGS. 13-14 are flow charts illustrating a method of driving a liquid crystal display according to an exemplary embodiment of the invention.
Figure 14:
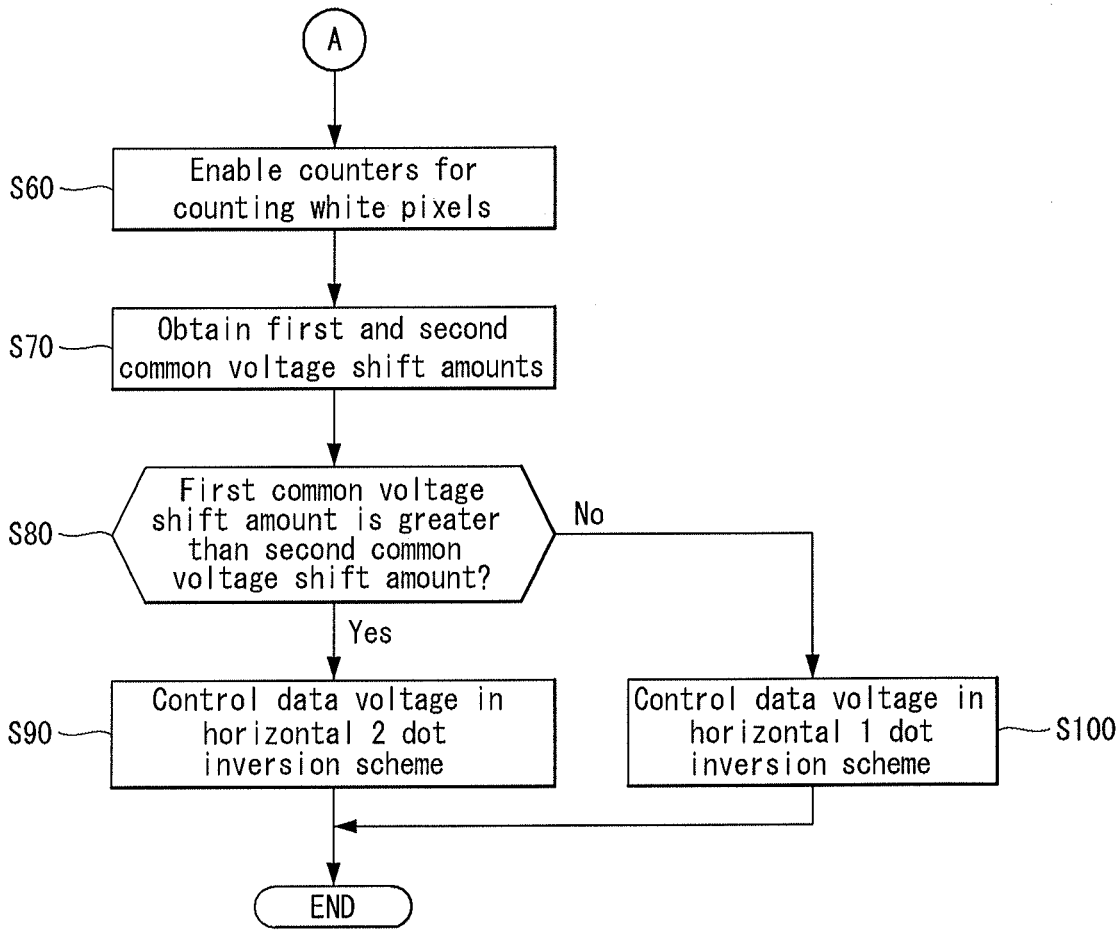

FIGS. 13-14 are flow charts illustrating a method of driving the liquid crystal display according to the exemplary embodiment of the invention.

As shown in FIGS. 13-14, the timing controller compares a sample data having a predetermined size among data of one frame of the input image with a reference data pattern for detecting the flicker pattern previously stored in the memory in each subpixel and decide whether or not the sample data is the same as the reference data pattern in steps S10, S20, and S30.

When the sample data is the same as the reference data pattern, the timing controller recognizes the input image data as the flicker pattern generating the common voltage shift and generates the first problem pattern flag of the high logic level. The timing controller disables the operations of the counters for counting the dominant polarities of the white pixels to represent data of the white gray level and generates the horizontal polarity control signal of the low logic level. The timing controller then controls the polarities of the data voltages in the horizontal 1 dot inversion scheme specified to a default value in the source driver ICs without changing the dot inversion scheme in steps S40 and S50.

When the sample data is not the same as the reference data pattern, the timing controller decides that the input image data is not the flicker pattern, and generates the first problem pattern flag of the low logic level. The timing controller then enables the operations of the counters for counting the dominant polarities of the white pixels to represent data of the white gray level The timing controller respectively maps the input image data to the polarity patterns of the horizontal 1 dot inversion scheme and counts the number of white gray level data mapped to the positive polarity and the number of white gray level data mapped to the negative polarity. The timing controller obtains the first common voltage shift amount indicating the shift amount of the common voltage when inverting the polarities of the data voltages of the input image in the horizontal 1 dot inversion scheme. Further, the timing controller respectively maps the input image data to the polarity patterns of the horizontal 2 dot inversion scheme and counts the number of white gray level data mapped to the positive polarity and the number of white gray level data mapped to the negative polarity. The timing controller obtains the second common voltage shift amount indicating the shift amount of the common voltage when inverting the polarities of the data voltages of the input image in the horizontal 2 dot inversion scheme in steps S60 and S70.

The timing controller compares the first common voltage shift amount with the second common voltage shift amount in steps S80.

When the first common voltage shift amount is greater than the second common voltage shift amount, the timing controller recognizes the input image data as the problem patterns other than the flicker pattern and generates the second problem pattern flag of the high logic level. The timing controller generates the horizontal polarity control signal of the high logic level and controls the polarities of the data voltages in the horizontal 2 dot inversion scheme through the change in the dot inversion scheme in step S90.

When the first common voltage shift amount is less than the second common voltage shift amount, the timing controller recognizes the input image data as a normal data and generates the second problem pattern flag of the low logic level. The timing controller generates the horizontal polarity control signal of the low logic level and controls the polarities of the data voltages in the horizontal 1 dot inversion scheme without changing the dot inversion scheme in step S100.

As described above, the liquid crystal display and the method of driving the same according to the embodiment of the invention previously defines various types of problem patterns such as the shutdown pattern, the smear pattern, and the flicker pattern. Thus, when the problem patterns other than the flicker pattern are input, the liquid crystal display is driven in the horizontal 2 dot inversion scheme to thereby minimize the shift of the common voltage. Hence, the image quality of the liquid crystal display is improved. Further, when the flicker pattern is input, the liquid crystal display is driven in the horizontal 1 dot inversion scheme and holds the shifted state of the common voltage, thereby making it possible to perform the tuning process of the common voltage.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display comprising:

a liquid crystal display panel on which data lines and gate lines cross each other;

a data driving circuit configured to convert data of an input image into positive and negative analog data voltages and output the positive and negative analog data voltages to the data lines;

a gate driving circuit configured to sequentially supply a gate pulse synchronized with the data voltages to the gate lines; and a timing controller configured to supply the input image data to the data driving circuit, control an operation timing of each of the data driving circuit and the gate driving circuit, compare the input image data with a previously stored reference data pattern, and decide whether the input image data is the same as the reference data pattern, wherein when the input image data is the same as the reference data pattern, the timing controller recognizes the input image data as a first problem pattern, disables an operation for counting data of a white gray level, and controls horizontal polarities of the data voltages output from the data driving circuit in a horizontal 1 dot inversion scheme, wherein when the input image data is not the same as the reference data pattern, the timing controller recognizes the input image data as a second problem pattern, enables the operation for counting the data of the white gray level, decides a shift of a common voltage based on a count value, and controls the horizontal polarities of the data voltages output from the data driving circuit in a horizontal 2 dot inversion scheme so as to minimize the shift of the common voltage.

2. The liquid crystal display of claim 1, wherein the timing controller includes:

a first problem pattern recognition unit configured to detect the first problem pattern;

a second problem pattern recognition unit configured to detect the second problem pattern; and a polarity control unit configured to determine a logic level of a horizontal polarity control signal based on a logic level of a first problem pattern flag received from the first problem pattern recognition unit and a logic level of a second problem pattern flag received from the second problem pattern recognition unit.

3. The liquid crystal display of claim 2, wherein the first problem pattern recognition unit extracts a sample data of a predetermined size among data of one frame of the input image, compares the extracted sample data with the reference data pattern in each subpixel, decides whether or not the sample data is the same as the reference data pattern, generates the first problem pattern flag of a high logic level when the sample data is the same as the reference data pattern, and generates the first problem pattern flag of a low logic level when the sample data is not the same as the reference data pattern.

4. The liquid crystal display of claim 2, wherein the second problem pattern recognition unit respectively maps the input image data to polarity patterns of the horizontal 1 dot inversion scheme using first and second counters enabled only when the first problem pattern flag of the low logic level is received, counts the number of data of the white gray level mapped to a positive polarity and the number of data of the white gray level mapped to a negative polarity, and obtains a first common voltage shift amount indicating a shifted amount of the common voltage when the polarities of the data voltages are inverted in the horizontal 1 dot inversion scheme, wherein the second problem pattern recognition unit respectively maps the input image data to polarity patterns of the horizontal 2 dot inversion scheme using third and fourth counters enabled only when the first problem pattern flag of the low logic level is received, counts the number of data of the white gray level mapped to the positive polarity and the number of data of the white gray level mapped to the negative polarity, and obtains a second common voltage shift amount indicating a shifted amount of the common voltage when the polarities of the data voltages are inverted in the horizontal 2 dot inversion scheme, wherein the second problem pattern recognition unit compares the first common voltage shift amount with the second common voltage shift amount, generates the second problem pattern flag of the high logic level when the first common voltage shift amount is greater than the second common voltage shift amount, and generates the second problem pattern flag of the low logic level when the first common voltage shift amount is less than the second common voltage shift amount.

5. The liquid crystal display of claim 2, wherein when the first problem pattern flag of the high logic level or the second problem pattern flag of the low logic level is input, the polarity control unit generates the horizontal polarity control signal of the low logic level and controls the polarities of the data voltages in the horizontal 1 dot inversion scheme specified to a default value without changing a dot inversion scheme, wherein when the first problem pattern flag of the low logic level and the second problem pattern flag of the high logic level are input, the polarity control unit generates the horizontal polarity control signal of the high logic level and controls the polarities of the data voltages in the horizontal 2 dot inversion scheme through a change in a dot inversion scheme.

6. A method of driving a liquid crystal display including a liquid crystal display panel on which data lines and gate lines cross each other, a data driving circuit that converts digital video data into positive and negative analog data voltages and outputs the positive and negative analog data voltages to the data lines, and a gate driving circuit sequentially supplying a gate pulse synchronized with the data voltages to the gate lines, the method comprising steps of:

(A) comparing an input image data with a previously stored reference data pattern, deciding whether the input image data is the same as the reference data pattern, when the input image data is the same as the reference data pattern, recognizing the input image data as a first problem pattern, disabling an operation for counting data of a white gray level, and controlling horizontal polarities of the data voltages output from the data driving circuit in a horizontal 1 dot inversion scheme; and (B) when the input image data is not the same as the reference data pattern, recognizing the input image data as a second problem pattern, enabling the operation for counting the data of the white gray level, deciding a shift of a common voltage based on a count value, and controlling the horizontal polarities of the data voltages output from the data driving circuit in a horizontal 2 dot inversion scheme so as to minimize the shift of the common voltage.

7. The method of claim 6, further comprising generating a horizontal polarity control signal for controlling the horizontal polarities of the data voltages output from the data driving circuit, wherein a logic level of the horizontal polarity control signal is determined based on a logic level of a first problem pattern flag and a logic level of a second problem pattern flag.

8. The method of claim 7, wherein the step (A) includes extracting a sample data of a predetermined size among data of one frame of the input image so as to recognize the first problem pattern, comparing the extracted sample data with the reference data pattern in each subpixel, deciding whether or not the sample data is the same as the reference data pattern, generating the first problem pattern flag of a high logic level when the sample data is the same as the reference data pattern, and generating the first problem pattern flag of a low logic level when the sample data is not the same as the reference data pattern.

9. The method of claim 8, wherein the step (B) includes:

respectively mapping the input image data to polarity patterns of the horizontal 1 dot inversion scheme using first and second counters enabled only when the first problem pattern flag of the low logic level is received, counting the number of data of the white gray level mapped to a positive polarity and the number of data of the white gray level mapped to a negative polarity, and obtaining a first common voltage shift amount indicating a shifted amount of the common voltage when the polarities of the data voltages are inverted in the horizontal 1 dot inversion scheme;

respectively mapping the input image data to polarity patterns of the horizontal 2 dot inversion scheme using third and fourth counters enabled only when the first problem pattern flag of the low logic level is received, counting the number of data of the white gray level mapped to the positive polarity and the number of data of the white gray level mapped to the negative polarity, and obtaining a second common voltage shift amount indicating a shifted amount of the common voltage when the polarities of the data voltages are inverted in the horizontal 2 dot inversion scheme; and comparing the first common voltage shift amount with the second common voltage shift amount, generating the second problem pattern flag of the high logic level when the first common voltage shift amount is greater than the second common voltage shift amount, and generating the second problem pattern flag of the low logic level when the first common voltage shift amount is less than the second common voltage shift amount.

10. The method of claim 9, wherein when the first problem pattern flag of the high logic level or the second problem pattern flag of the low logic level is input, the horizontal polarity control signal is generated at the low logic level and controls the polarities of the data voltages in the horizontal 1 dot inversion scheme specified to a default value without changing a dot inversion scheme, wherein when the first problem pattern flag of the low logic level and the second problem pattern flag of the high logic level are input, the horizontal polarity control signal is generated at the high logic level and controls the polarities of the data voltages in the horizontal 2 dot inversion scheme through a change in a dot inversion scheme.

* * * * *